US006974201B2

(12) United States Patent
Kanemura

(10) Patent No.: US 6,974,201 B2
(45) Date of Patent: Dec. 13, 2005

(54) INKJET PRINTING APPARATUS

(75) Inventor: Shoji Kanemura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 10/697,721

(22) Filed: Oct. 29, 2003

(65) Prior Publication Data

US 2004/0090487 A1 May 13, 2004

(30) Foreign Application Priority Data

Oct. 31, 2002 (JP) ..... 2002-318215
Oct. 20, 2003 (JP) ..... 2003-359242

(51) Int. Cl.[7] ..... B41J 2/165
(52) U.S. Cl. ..... 347/23; 347/19; 347/23; 347/14
(58) Field of Search ..... 347/14, 23, 30, 347/19, 29

(56) References Cited

U.S. PATENT DOCUMENTS 5,942,043 A * 8/1999 Suemune ..... 134/18
6,817,694 B1 * 11/2004 Kawasaki et al.
2004/0257392 A1 * 12/2004 Brenner et al. ..... 347/14

FOREIGN PATENT DOCUMENTS

JP 2002059559 A * 2/2002 ..... B41J 2/165

* cited by examiner

*Primary Examiner*—Stephen Meier
*Assistant Examiner*—Ly T. Tran
(74) *Attorney, Agent, or Firm*—Morgan & Finnegan, LLP

(57) ABSTRACT

A full-line type printing apparatus having plural printheads which simultaneously performs printing processing using a printhead within a printing area of a print medium and preliminary discharge processing on a printhead without the printing area of the print medium in a stable manner. For this purpose, upon printing by the respective printheads based on received print data, electric power supplied to the respective printheads are calculated, and it is determined whether or not the sum of electric power supplied to simultaneously driven printheads is within a threshold value. If the sum is greater than the threshold value, a flag is set. Next, upon print-output of the print data, the existence/absence of the flag is checked, and if the flag is not set, normal printing is performed, while if the flag is set, a printhead driving frequency is changed before printing.

8 Claims, 13 Drawing Sheets

FIG. 6B

| | TIME | NUMBER OF PRINTING ELEMENT SGI ( SGI = LK + LC + LM + LY ) | | | | |
|---|---|---|---|---|---|---|
| | | NUMBER LK OF K PRINTING ELEMENTS | NUMBER LC OF C PRINTING ELEMENTS | NUMBER LM OF M PRINTING ELEMENTS | NUMBER LY OF Y PRINTING ELEMENTS | NUMBER OF PRINTING ELEMENT S FOR PRELIMINARY DISCHARGE |
| PRINTING FOR 1ST PAGE (Y) | $t_1$ | $31d_1$ | | | | |
| | $t_2$ | $31d_2$ | | | | |
| | $t_3$ | $31d_3$ | $32d_1$ | | | |
| | $t_4$ | $31d_4$ | $32d_2$ | | | |
| | $t_5$ | $31d_5$ | $32d_3$ | $33d_1$ | | |
| | $t_6$ | $31d_6$ | $32d_4$ | $33d_2$ | | |
| | $t_7$ | $31d_7$ | $32d_5$ | $33d_3$ | $34d_1$ | |
| | $t_8$ | $31d_8$ | $32d_6$ | $33d_4$ | $34d_2$ | |
| | $t_9$ | $31d_9$ | $32d_7$ | $33d_5$ | $34d_3$ | |
| | $t_{10}$ | $31d_{10}$ | $32d_8$ | $33d_6$ | $34d_4$ | |
| | $t_{11}$ | $31d_{11}$ | $32d_9$ | $33d_7$ | $34d_5$ | |
| | $t_{12}$ | $31d_{12}$ | $32d_{10}$ | $33d_8$ | $34d_6$ | |
| | $t_{13}$ | $31d_{13}$ | $32d_{11}$ | $33d_9$ | $34d_7$ | |
| | $t_{14}$ | | $32d_{12}$ | $33d_{10}$ | $34d_8$ | |
| PRELIMINARY DISCHARGE BETWEEN 1ST PAGE AND 2ND PAGE | $t_{15}$ | | $32d_{13}$ | $33d_{11}$ | $34d_9$ | $Y_{1d}$ |
| | $t_{16}$ | | | $33d_{12}$ | $34d_{10}$ | $Y_{1d}$ |
| | $t_{17}$ | | | $33d_{13}$ | $34d_{11}$ | $Y_{2d}$ |
| PRINTING FOR 2ND PAGE (Y) | $t_{18}$ | $31d_1$ | | | $34d_{12}$ | $Y_{2d}$ |
| | $t_{19}$ | $31d_2$ | | | $34d_{13}$ | $Y_{3d}$ |
| | $t_{20}$ | $31d_3$ | $32d_1$ | | | $Y_{3d}$ |
| | $t_{21}$ | $31d_4$ | $32d_2$ | | | $Y_{4d}$ |
| | $t_{22}$ | $31d_5$ | $32d_3$ | $33d_1$ | | $Y_{4d}$ |
| | $t_{23}$ | $31d_6$ | $32d_4$ | $33d_2$ | | |
| | $t_{24}$ | $31d_7$ | $32d_5$ | $33d_3$ | $34d_1$ | |
| | $t_{25}$ | $31d_8$ | $32d_6$ | $33d_4$ | $34d_2$ | |
| | $t_{26}$ | $31d_9$ | $32d_7$ | $33d_5$ | $34d_3$ | |
| | $t_{27}$ | $31d_{10}$ | $32d_8$ | $33d_6$ | $34d_4$ | |
| | $t_{28}$ | $31d_{11}$ | $32d_9$ | $33d_7$ | $34d_5$ | |
| | $t_{29}$ | $31d_{12}$ | $32d_{10}$ | $33d_8$ | $34d_6$ | |
| | $t_{30}$ | $31d_{13}$ | $32d_{11}$ | $33d_9$ | $34d_7$ | |
| | $t_{31}$ | | $32d_{12}$ | $33d_{10}$ | $34d_8$ | |
| | $t_{32}$ | | $32d_{13}$ | $33d_{11}$ | $34d_9$ | |
| | $t_{33}$ | | | $33d_{12}$ | $34d_{10}$ | |
| | ⋮ | | | ⋮ | ⋮ | |

FIG. 10

| PATTERN | PRELIMINARY DISCHARGE PROFILE | PRELIMINARY DISCHARGE POWER Ppre |
|---|---|---|
| 1 | DISCHARGE FROM ONLY ODD-NUMBERED PRINTING ELEMENTS | $P_1$ |
| 2 | DISCHARGE FROM ONLY EVEN-NUMBERED PRINTING ELEMENTS | $P_2$ |
| 3 | DISCHARGE FROM ALL PRINTING ELEMENTS | $P_3$ |
| ⋮ | ⋮ | ⋮ |
| n | XXX | XXX |

FIG. 11

| NUMBER | DRIVING FREQUENCY (Hz) | DRIVING POWER (w) |
|---|---|---|
| 1 | XXX | $P_1$ |
| 2 | XXX | $P_2$ |
| 3 | XXX | $P_3$ |
| ⋮ | ⋮ | ⋮ |
| n | XXX | XXX |

INKJET PRINTING APPARATUS

CLAIM OF PRIORITY

This application claims priorities under 35 U.S.C. § 119 from Japanese Patent Application No. 2002-318215, entitled "An Inkjet Printer" and filed on Oct. 31, 2002, and Japanese Patent Application No. 2003-359242, entitled "An Inkjet Printer and A Drive Control method thereof, A Control Program and A Computer-readable Recording Medium" and filed on Oct. 20, 2003, the entire contents of which are hereby incorporated by reference herein.

FIELD OF THE INVENTION

The present invention relates to inkjet printing control, and more particularly, to drive control of an inkjet printing apparatus having plural full-line type inkjet printheads each having printing elements corresponding to the width of a print medium.

BACKGROUND OF THE INVENTION

A printer which prints desired character or image information on a sheet type print medium such as paper or a film is known as an information output apparatus in a word processor, a personal computer, a facsimile machine and the like.

In recent years, among various known printing methods, an inkjet method especially attracts attention in recent years by virtue of its capabilities of printing without contact with a print medium such as a print sheet and color printing, a low running cost, quiet operation by non-impact method and the like.

Further, among the inkjet printing apparatuses, a full-line type printing apparatus having a printhead with a printing element (nozzle) array corresponding to a printing width, which performs printing while conveying a print medium, is becoming widely used since the printing speed can be further increased.

In this full-line type printing apparatus, plural printheads to discharge different color inks are arrayed in a conveying direction of the print medium, and the inks are simultaneously discharged from the respective printheads, thereby the printing speed is not lowered even upon color printing.

In this printing apparatus, when all the printheads are simultaneously driven, electric power necessary for the printing exceeds the power supply capability of a power source. Accordingly, in many cases, when power necessary for printing, calculated from the number of driven printing elements or the like exceeds a predetermined threshold value, the electric consumption is reduced by e.g. changing a printhead driving frequency.

In this inkjet printing apparatus, the printhead is schematically constructed with an energy generator to generate energy to be supplied to ink, for discharging the ink from a discharge orifice as ink droplets, an ink channel including the energy generator inside and communicated with the discharge orifice, and ink containing means such as an ink tank containing the ink supplied through the ink channel to the energy generator.

In the printhead, to maintain an excellent ink discharge state in each printing element, preliminary discharge to discharge ink from the orifices of the respective printing elements must be performed periodically.

For this purpose, the printing apparatus has containing means for containing preliminarily-discharged ink, suction means for moving the ink stored in the containing means to a predetermined position, and the like. Further, the containing means has cap means for moisture retention of the discharge orifices of the respective printing elements, thus constructs, with the suction means, recovery means for recovery of the discharge characteristic of the printhead.

Upon printing on plural print media, to maintain printing quality and discharge performance, it is necessary to perform recovery processing or preliminary discharge in the middle of the printing. However, if the recovery processing using the recovery means is performed in the middle of the printing operation, as the printing is suspended, the printing time is greatly prolonged.

For this reason, to maintain the discharge performance without increasing the printing time, the preliminary discharge is performed, in place of the recovery processing, on a print medium or on a conveying member to convey the print medium.

Accordingly, in the full-line type printing apparatus having plural printheads, printing on a print medium and the preliminary discharge are simultaneously performed. As the above-described predetermined threshold value regarding the electric power is set to a maximum value that the power source can supply, if electric power by the preliminary discharge is added, the electric consumption may exceed the capability of the power source.

SUMMARY OF THE INVENTION

The present invention has been made in view of the above problems, and provides a printing apparatus, having plural full-line type printheads, which can simultaneously perform printing processing to a printing medium using a printhead within a print data area of the print medium and preliminary discharge processing on a printhead without the print data area, in a stable manner, even if electric power necessary for these processings exceeds a maximum value that a power source can supply to the printing apparatus.

According to one aspect of the present invention, to solve the above problems, provided is an ink-jet printing apparatus having plural full-line type inkjet printheads each having an array of printing elements corresponding to a width of a print medium, comprising: control means for, when print data is received, simultaneously performing print-output of the print data by the printhead within a printing area of the print medium and preliminary discharge from the printhead without the printing area of the print medium; driving electric-power calculation means for calculating driving electric power to simultaneously perform the print-output of the print data and the preliminary discharge, by a predetermined length in a conveyance direction of the print medium; and determination means for determining whether or not the calculated driving electric power is greater than a threshold value indicating an upper limit of driving electric power to simultaneously perform the print-output of the print data and the preliminary discharge, wherein if the calculated driving electric power is greater than the threshold value, the control means reduces electric power supplied to the printhead to a value less than the threshold value.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention, in which:

FIG. 6B is a table showing the number of printing elements used for printing and the number of printing elements used for the preliminary discharge at each time in FIG. 6A;

FIG. 10 is an example of a preliminary discharge pattern table used in FIG. 7; and FIG. 11 is an example of a frequency change table used in FIG. 7.

DETAILED DESCRIPTION OF THE PREFERRED EMBODIMENTS

Hereinbelow, preferred embodiments of the present invention will be described in detail in accordance with the accompanying drawings.

Note that in the following embodiment, a printer is given as a printing apparatus using an inkjet printing method.

In this specification, "print" is not only to form significant information such as characters and graphics, but also to form, e.g., images, figures, and patterns on printing media in a broad sense, regardless of whether the information formed is significant or insignificant or whether the information formed is visualized so that a human can visually perceive it, or to process printing media.

"Print media" are any media capable of receiving ink, such as cloth, plastic films, metal plates, glass, ceramics, wood, and leather, as well as paper sheets used in common printing apparatuses.

Furthermore, "ink" (to be also referred to as "liquid") should be broadly interpreted like the definition of "print" described above. That is, ink is a liquid which is applied onto a printing medium and thereby can be used to form images, figures, and patterns, to process the printing medium, or to process ink (e.g., to solidify or insolubilize a colorant in ink applied to a printing medium).

Figure 1:
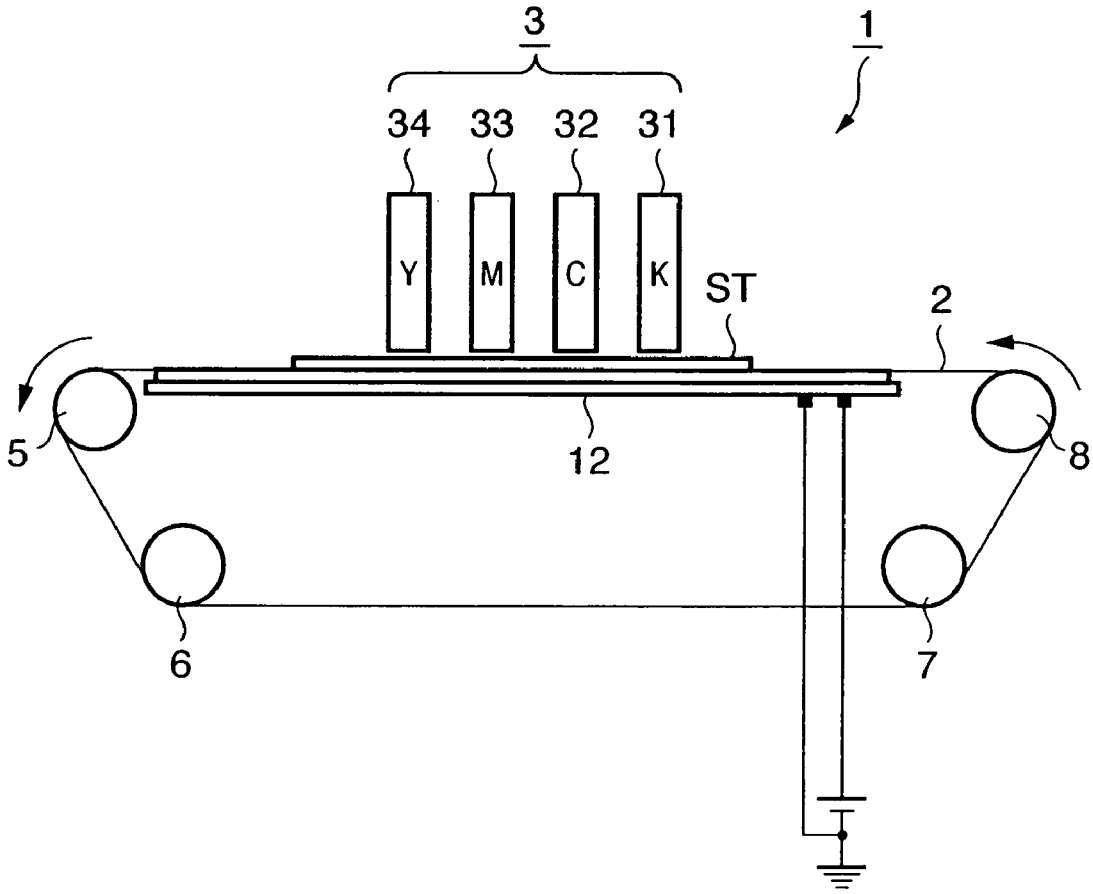
FIG. 1 is a cross-sectional view showing a schematic structure of an inkjet printing apparatus according to an embodiment of the present invention.

[Schematic Structure of Inkjet Printing Apparatus: FIG. 1]

FIG. 1 is a cross-sectional view showing a schematic structure of an inkjet printing apparatus 1 according to an embodiment of the present invention. Reference numeral 3 denotes a printhead having 4 printheads 31 to 34 to discharge black (K), cyan (C), magenta (M) and yellow (Y) color inks. These printheads, driven by a controller to be described later, discharge ink droplets of respective colors upon color printing.

A sheet type print medium (hereinbelow simply referred to as a "sheet") ST is fed from a feeding portion (not shown), moved by a conveyance belt 2 while it is electrostatically attracted to the conveyance belt 2, and when the sheet is passed under the printhead 3, printing is performed. The conveyance belt 2 as a conveyance device, having a circular belt shape, is put around a conveyance belt driving roller 5 and support rollers 6 to 8 and is rotate-driven, thereby the sheet ST is conveyed.

Figure 2A:
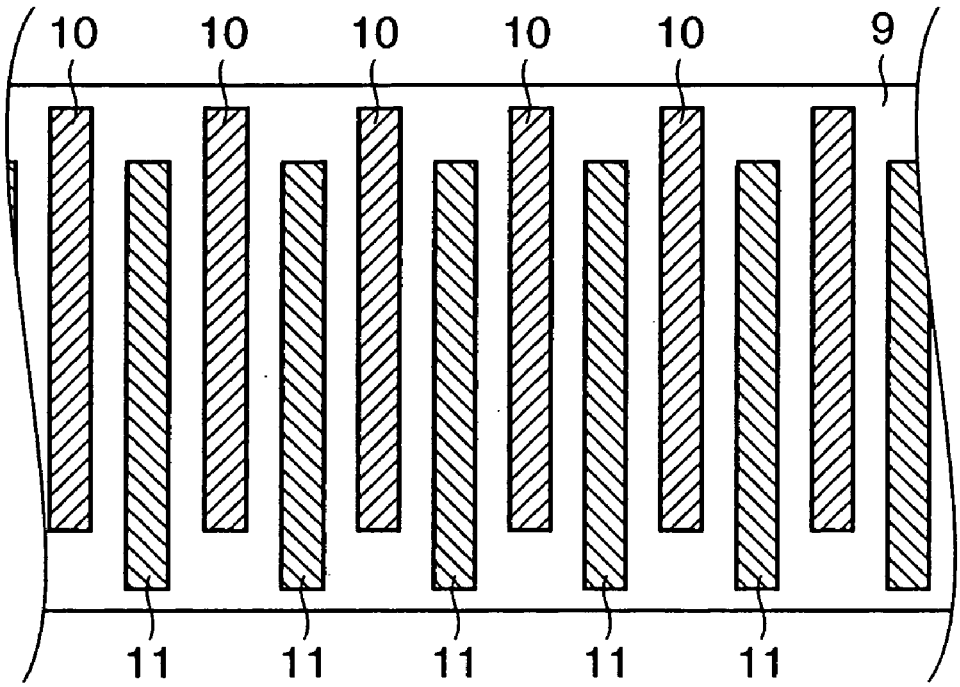
FIGS. 2A and 2B are to plan view and expanded cross-sectional view of a conveyance portion of the printing apparatus in FIG. 1.
Figure 2B:
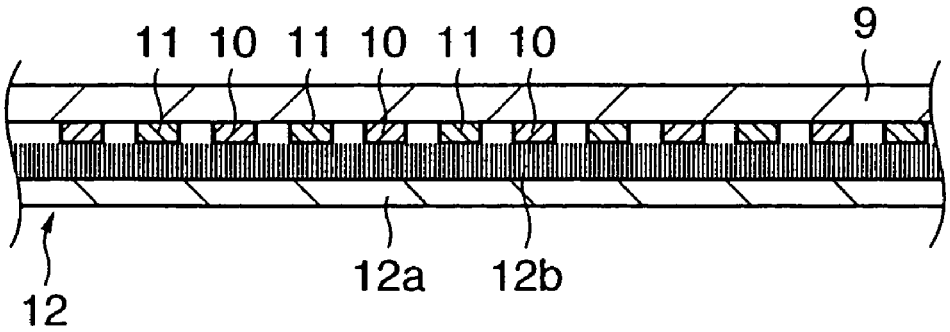
Figure 3:
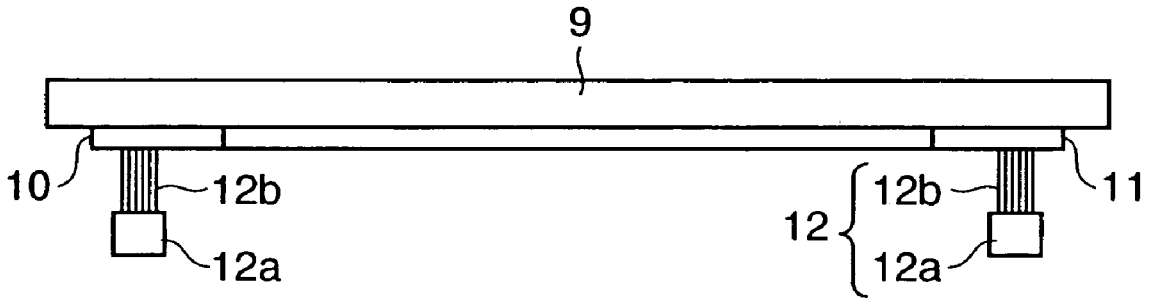
FIG. 3 is a front view of the conveyance portion of the printing apparatus in FIG. 1 viewed from a direction orthogonal to a conveyance direction.

[Structure of Conveyance Belt: FIGS. 2A, 2B and 3]

FIGS. 2A and 2B are plan view and expanded cross-sectional view of the conveyance belt 2. As shown in these figures, the conveyance belt 2 has comb electrodes 10 as a first electrode group and a comb electrodes 11 as a second electrode group, as electrostatic attraction means where strip-shaped electrodes are alternately arranged, on a surface of a dielectric film 9 as a base opposite to a conveyance surface of the film. The comb electrodes 11 are provided between the comb electrodes 10, i.e., the electrodes are alternately provided in a conveyance direction.

As the comb electrodes 10 and 11, for example, an electrode having a thickness of 35 $\mu$m and a width of 8 mm is provided at 8 mm intervals on the surface of the dielectric film layer 9. At both ends of the conveyance belt 2, a conductive brush 12 as shown in FIG. 2B is provided as power feeding means. The conductive brush 12 has a conductive brush 12*b* on a base material 12*a*.

FIG. 3 is a front view of the conveyance belt 2 viewed from a direction orthogonal to the conveyance direction. As shown in FIG. 3, power feeding is performed by contact between the brush 12*b* of the conductive brush 12 and the comb electrodes 10 and 11 on the film layer 9 of the conveyance belt 2.

When an electric potential is caused in the comb electrodes 10 and 11, an attraction force by electrostatic force can be obtained. In the present embodiment, the conductive brush 12 in contact with one of the comb electrodes 10 and 11 is grounded, and a voltage of about 0.5 to 2 kv is applied to the conductive brush 12 in contact with the other one of the comb electrodes 10 and 11, thereby a predetermined electrostatic force is obtained. When the conveyance belt 2 is rotated, power is fed from the conductive brush 12 by slide contact to the comb electrodes 10 and 11, then an electrostatic attraction force is generated, and the sheet ST, attracted to the conveyance belt 2, is conveyed.

Figure 4:
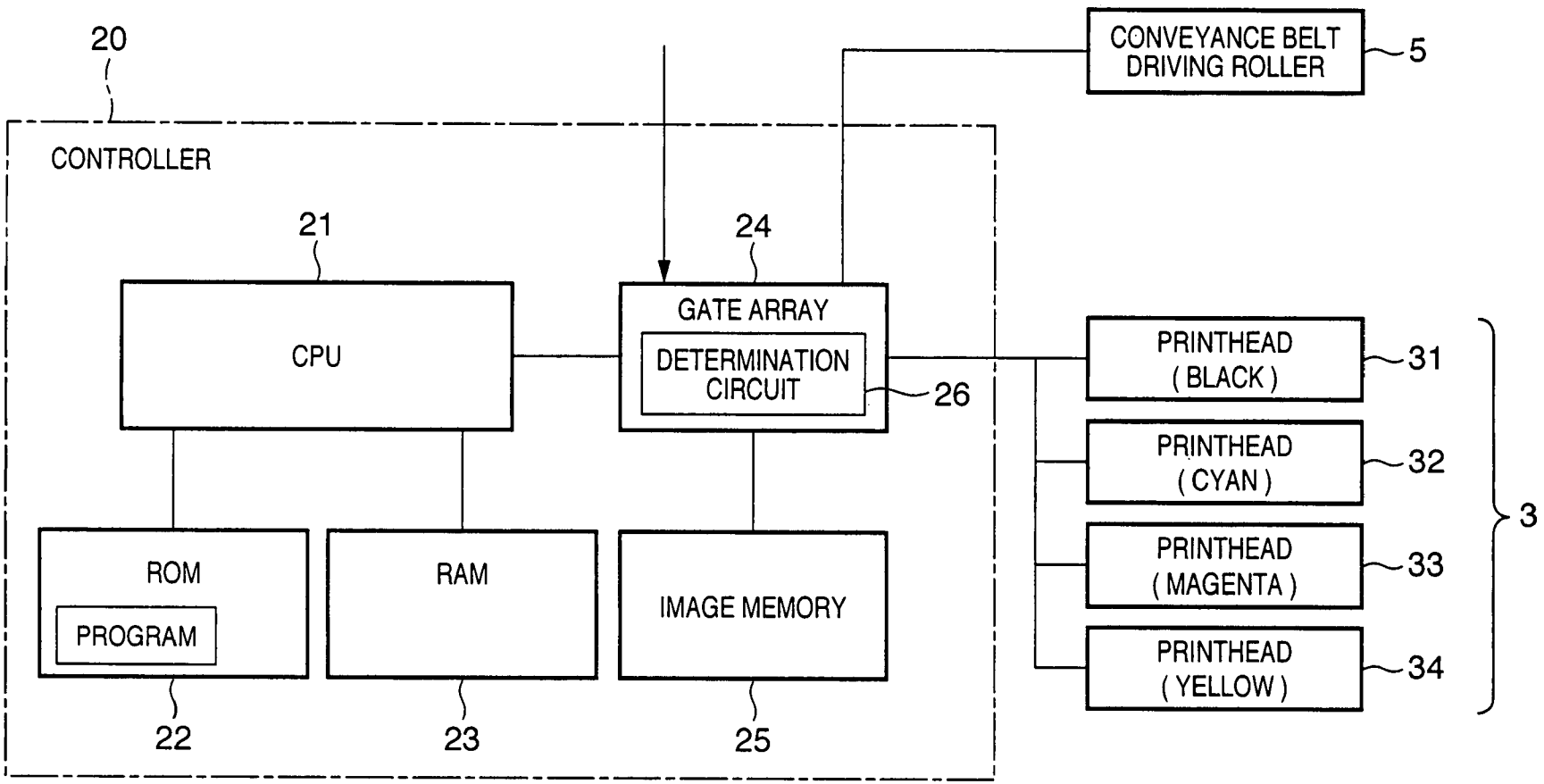
FIG. 4 is a block diagram showing a controller of the printing apparatus in FIG. 1.

[Control Construction of Inkjet Printing Apparatus: FIG. 4]

FIG. 4 is a block diagram showing a control construction of the inkjet printing apparatus of the present embodiment. In FIG. 4, the same elements as those in FIG. 1 have the same reference numerals. That is, the printhead 3 has the black printhead 31, the cyan printhead 32, the magenta printhead 33 and the yellow printhead 34, and numeral 5 denotes the conveyance belt driving roller.

Numeral 20 denotes a controller including a CPU 21, a ROM 22 for storing various programs such as a control program, a RAM 23 for storing work data necessary for control, and a gate array 24. The gate array 24 outputs a drive control signal to the conveyance belt driving roller 5, an image signal and a control signal to the printhead 3, and the like.

Numeral 25 denotes an image memory. The gate array 24 temporarily stores print data received from the outside. At the same time, the gate array determines by its internal determination circuit 26 whether or not a printing duty exceeds a threshold value. Then, based on the result of determination, the CPU 21 instructs the gate array to transmit an appropriate control signal to the printhead 3. More particularly, if the printing duty exceeds the threshold value, the CPU instructs the gate array to output a control signal to lower a driving frequency for the printhead so as to reduce electric consumption.

Figure 5:
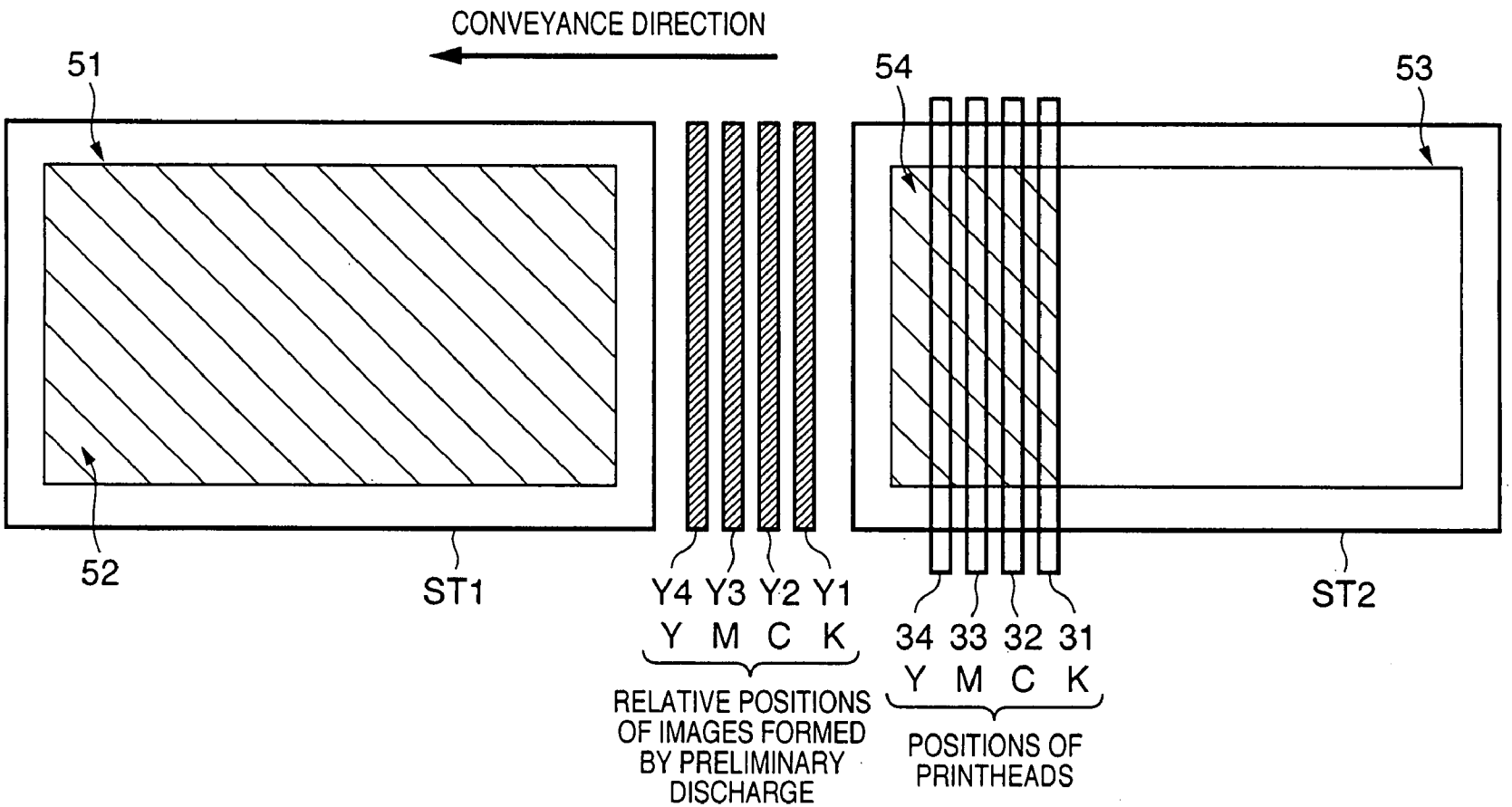
FIG. 5 is an explanatory view of image printing on two print media and preliminary discharge from printheads between the print media, showing relative positions of images formed by preliminary discharge to images printed within printing areas of first and second print media.

[Printing on Print Media and Preliminary Discharge Between Print Media: FIG. 5]

FIG. 5 is an explanatory view of image printing on two print media (ST1 and ST2) and preliminary discharge from the printheads between the print media according to the present embodiment. Numeral ST1 denotes a first print medium; and ST2, a second print medium. The respective print media are conveyed from the right to the left in the figure, and sequentially passed under the printheads 31 to 34, when printing is performed on the media. Hatched portions in printing areas 51 and 53 indicate images 52 and 54 printed within the printing areas. Further, in the present embodiment, the preliminary discharge is performed between the print medium ST1 and the print medium ST2.

Note that in FIG. 5, numeral Y1 denotes an image indicating the preliminary discharge from the printhead 31; Y2, an image indicating the preliminary discharge from the printhead Y32; Y3, an image indicating the preliminary discharge from the printhead 33; and Y4, a image indicating the preliminary discharge from the printhead 34. It is understood from the figure that the preliminary discharge is performed between the two print media (ST1 and ST2) utilizing a period where the print medium is not passed under the printhead.

Figure 6A:
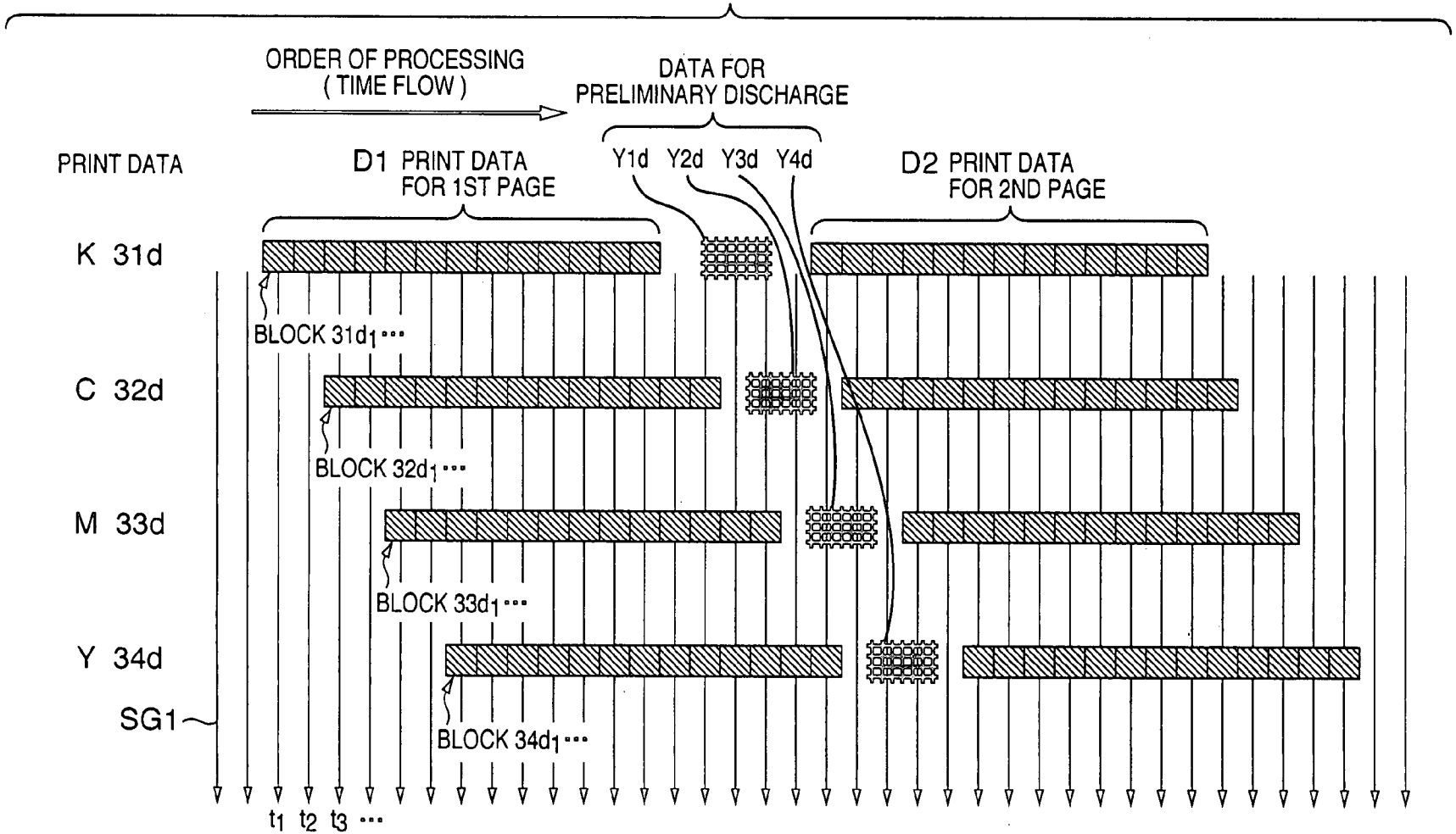
FIG. 6A is an explanatory view of processing in a determination circuit (FIG. 6C) of the controller in FIG. 4, showing the relation between the number of blocks used in printing and the preliminary discharge at each time.
Figure 6C:
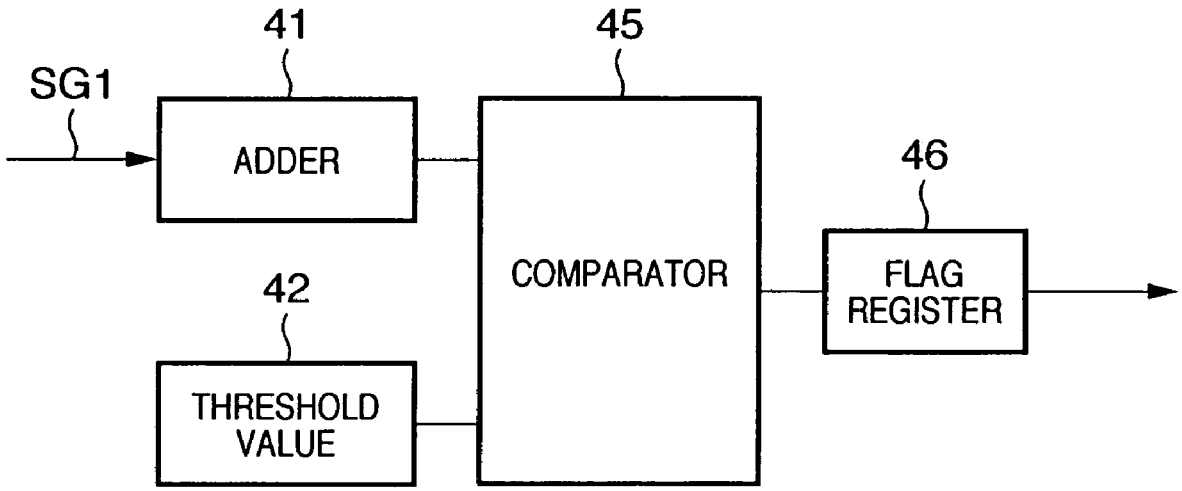
FIG. 6C is a block diagram showing the construction of the determination circuit used in FIGS. 6A and 6B.

[Processing by Determination Circuit: FIGS. 6A to 6C]

FIGS. 6A to 6C show the operation of the determination circuit 26 in the above-described gate array 24. FIG. 6A is an explanatory view showing the order (time flow) of the processing in the determination circuit 26 in FIG. 6C, i.e., the number of blocks used in printing at each time; FIG. 6B is a table showing the total number of printing elements (the number of print data) used for printing in the respective blocks at each time; and FIG. 6C is a block diagram showing the construction of the determination circuit for determination by comparing the total number of printing elements (the number of print data) used at each time in FIG. 6B with a threshold value.

In FIG. 6A, numerals 31*d* to 34*d* denote print data for the printheads 31 to 34. These data are stored on the image memory 25 and at the same time blocked by predetermined lines for calculation of printing duty.

Note that in FIG. 6A, numeral D1 denotes print data for the first page supplied to the black printhead 31 (D1 is divided into 13 blocks 31*d*1 to 31*d*13); D2, print data for the second page supplied to the printhead 31 (D2 is divided into 13 blocks 31*d*1 to 31*d*13); and Y1*d*, preliminary discharge data to the printhead 31. Further, although explanations will be omitted here, print data D1 and D2 for the first and second pages are similarly prepared for the cyan, magenta and yellow printheads 32 to 34. Further, numerals Y2*d* to Y4*d* denote preliminary discharge data to the printheads 32 to 34.

Note that electric power necessary for print-outputting received print data is calculated as the sum of electric power to drive printing elements necessary for printing in the respective printheads (the number of printing elements×electric power to drive 1 printing element).

In FIG. 6A, the process proceeds from the left to the right in accordance with reception of print data. Assuming that processing time for the respective blocks in FIG. 6A is t1, t2, . . . , a signal SGI is to guide the data for all the printheads to an adder 41 (FIG. 6C) by block units. As the respective printheads 31 to 34 are arrayed at certain intervals as shown in FIG. 1, upon addition of print data for simultaneous driving, it is necessary to perform addition by shifting the block by each printhead as shown in FIG. 6A.

FIG. 6B shows, as the number of print data simultaneously driven as shown in FIG. 6A, the signal SGI as a total value of the number of print data to drive black printing elements (LK), the number of print data to drive cyan printing elements (LC), the number of print data to drive magenta printing elements (LM), and the number of print data to drive yellow printing elements (LY) (SGI=LK+LC+LM+LY).

That is, at time t1, as the printing elements used in printing on the first print medium are only the black printing elements, SGI=31*d*1 holds. At time t3, as the printing elements used in printing on the first print medium are black+cyan printing elements, SGI= 31*d*3+32*d*1 holds. At time t5, as the printing elements used in printing on the first print medium are black+cyan+magenta printing elements, SGI=31*d*5+32*d*3+33*d*1 holds. At time t7, as the printing elements used in printing on the first print medium are black+cyan+magenta+yellow printing elements, SGI =31*d*7+32*d*5+33*d*3+34*d*1 holds.

Further, at time t15, as the printing elements used in printing on the first print medium are cyan+magenta+yellow printing elements, SGI=32*d*13+33*d*11+34*d*9 holds. At the same time, at time t15, prior to printing on the second print medium, preliminary discharge (Y4: FIG. 6A) is performed on the yellow printhead where the printing for the first print medium has been completed, between the first and second print media.

Further, at time t16, as the printing elements used in printing on the first print medium are magenta+yellow printing elements, SGI=33*d*12+34*d*10 holds. At the same time, at time t16, prior to printing on the second print medium, the preliminary discharge (Y4: FIG. 6A) is performed on the yellow printhead where the printing for the first print medium has been completed, between the first and second print media.

Hereinbelow, similarly, at time t17 and time t18, prior to printing on the second print medium, preliminary discharge (Y3: FIG. 6A) is performed on the cyan printhead where printing for the first print medium has been completed, between the first and second print media, then at time t19 and time t20, prior to printing on the second print medium, preliminary discharge (Y2: FIG. 6A) is performed on the magenta printhead where the printing for the first print medium has been completed, between the first and second print media, and at time t21 and time t22, prior to printing on the second print medium, preliminary discharge (Y1: FIG. 6A) is performed on the yellow printhead where the printing for the first print medium has been completed, between the first and second print media.

In FIG. 6C, numeral 41 denotes the adder, in which the data signal SGI of all the printheads is inputted by block and added; 42, a register for storing the threshold value; 45, a comparator which compares the result of addition with the threshold value; and 46, a flag register for storing a flag set in correspondence with the result of comparison.

The comparator 45 compares the result of addition outputted from the adder 41 with the threshold value, and if the result of addition exceeds the threshold value, set a flag and stores it into the flag register 46.

In this manner, as the sum of the number of printing elements related to printing for a predetermined number of lines (a predetermined length) is compared with the threshold value, if the threshold value is set to a value, obtained by subtracting a value of the electric power necessary for the preliminary discharge from electric power that the power source can supply, printing can be performed within the power supply capability of the power source, and the degradation of printed image can be prevented. Note that regarding the "predetermined length", an appropriate length is set based on the resistance of the power source to variation of load, and the "sum of the number of printing elements" means the sum of simultaneously driven elements related to printing within the predetermined length in the plural heads and the sum can be easily converted to electric power.

Figure 7:
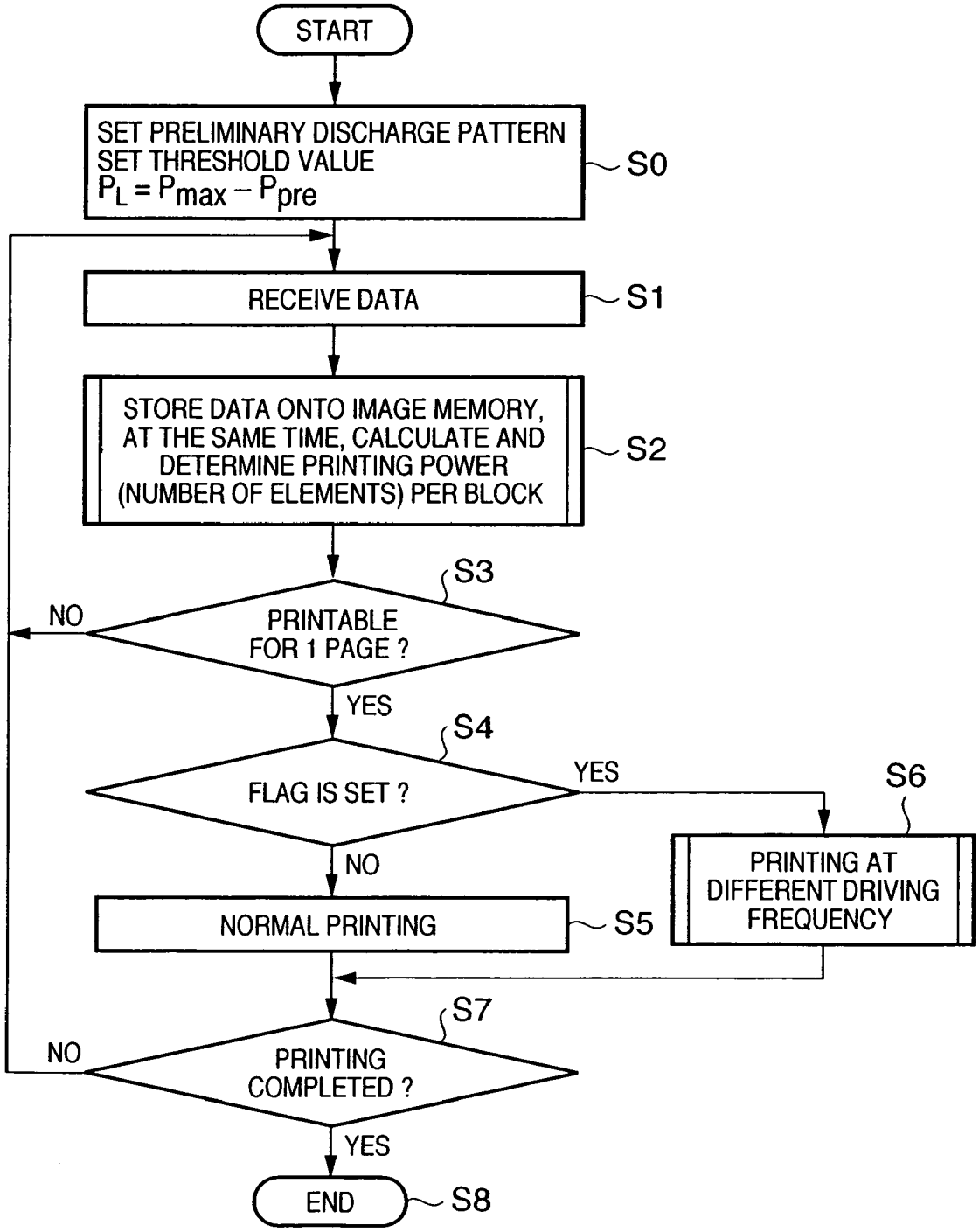
FIG. 7 is a flowchart of printing duty control processing in the printing apparatus in FIG. 1.
Figure 8:
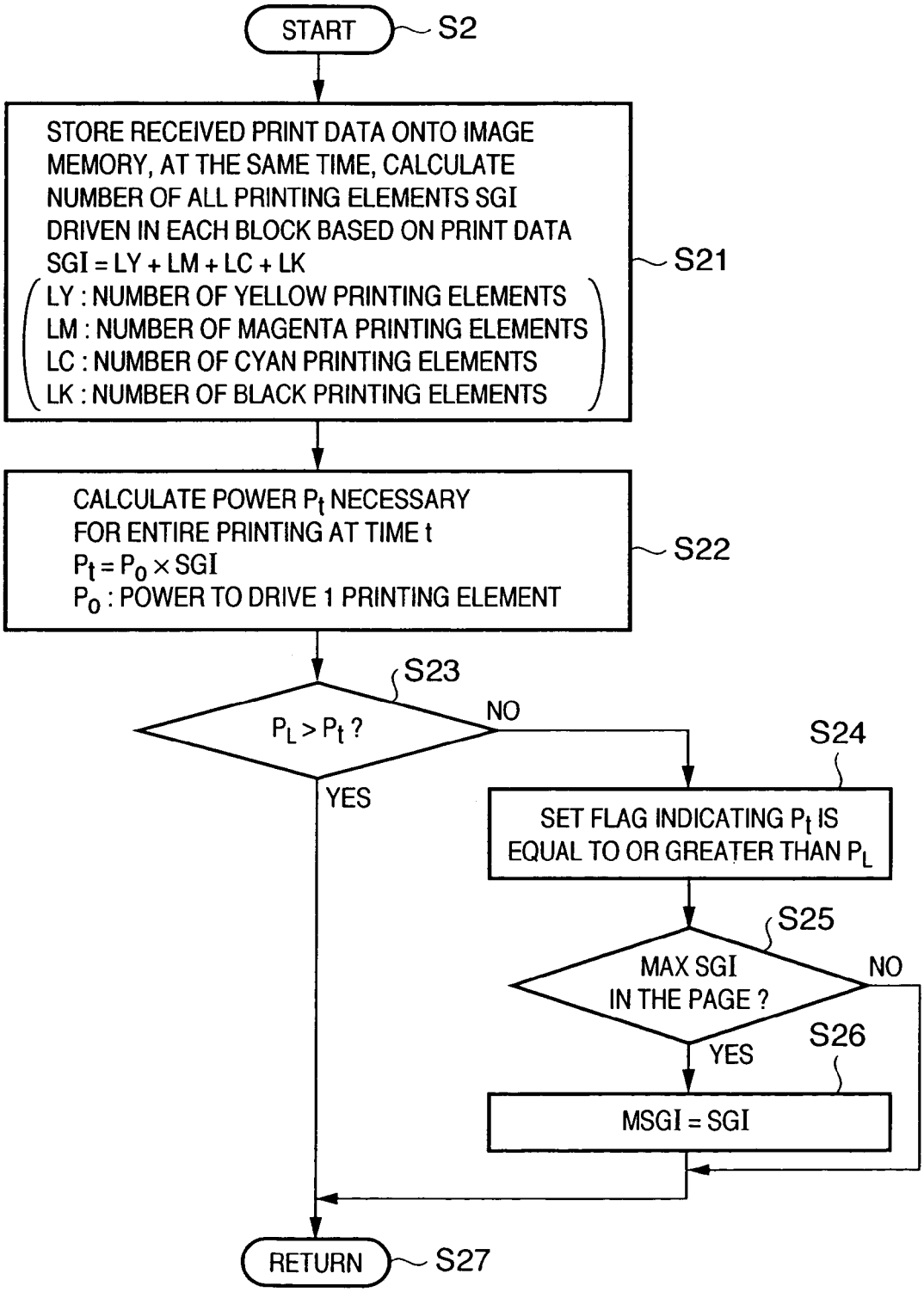
FIG. 8 is a flowchart explaining an example of the details of step S2 in FIG. 7.
Figure 9:
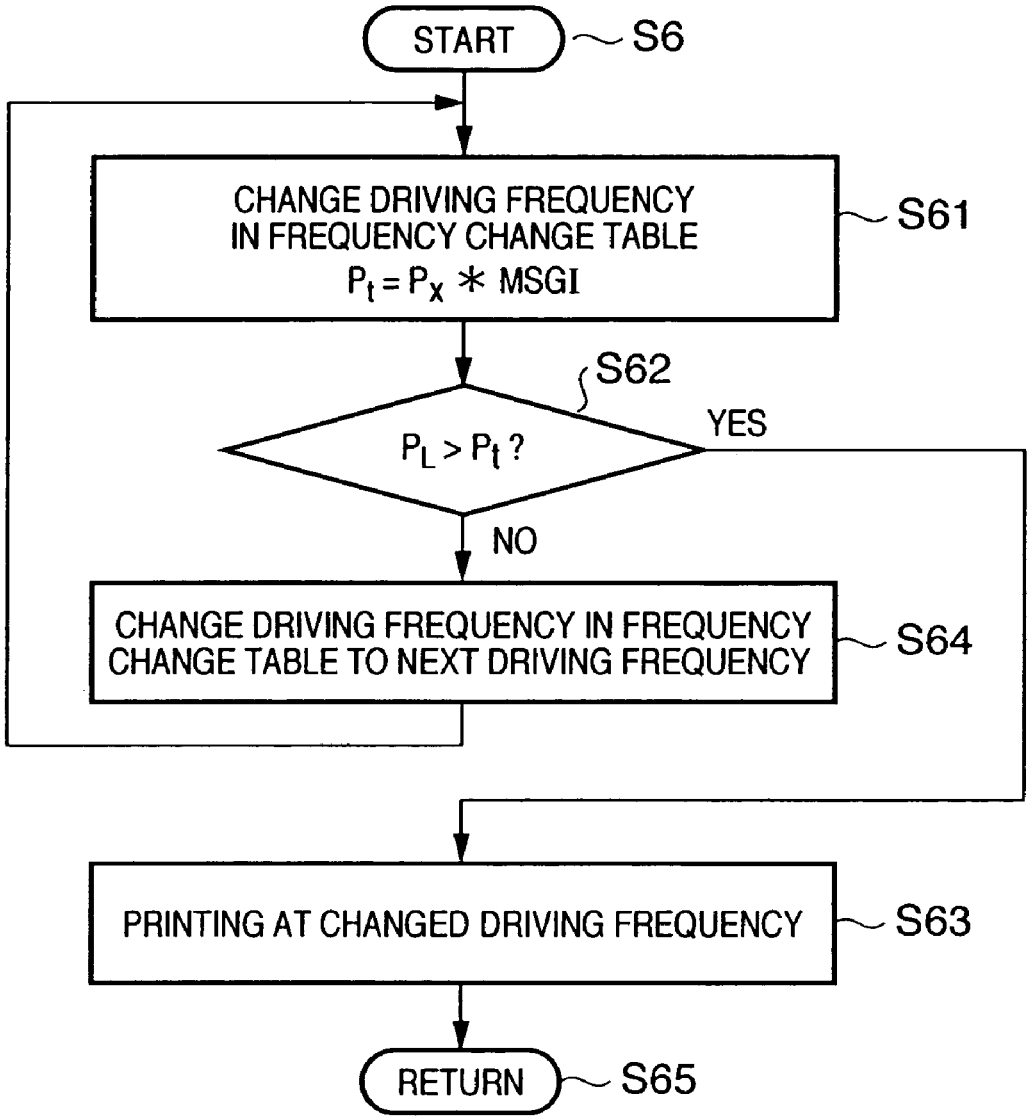
FIG. 9 is a flowchart explaining an example of the details of step S6 in FIG. 7.

[Printing Duty Control Processing: FIGS. 7 to 9]

Next, printing duty control processing according to the present embodiment will be described with reference to the flowcharts of FIGS. 7 to 9. This processing is performed by the controller 20 based on the control program stored on the ROM 22.

In FIG. 7, at step S0, the controller 20 reads a preliminary discharge pattern table as shown in FIG. 10 from the ROM 22 or the like, and stores a threshold value PL, obtained by subtracting an electric power value Ppre necessary for the preliminary discharge corresponding to a set preliminary discharge pattern from a maximum electric power value Pmax that the power source can supply to the printhead (PL=Pmax−Ppre), into the register 42. Note that in a case where a preliminary discharge pattern is not set, a preliminary discharge pattern previously set in the preliminary discharge pattern table is used.

Next, at step S1, the controller 20 receives print data, then at step S2, stores the received print data onto the image memory 25, and at the same time, controls the determination circuit 26, to calculate the printing duty by each block and compare the printing duty with the threshold value and to determine whether or not the electric power necessary for the entire printing exceeds the electric power value Pmax that the power source can supply the printhead.

FIG. 8 is a flowchart explaining the details of step S2 in FIG. 7. That is, at step S21, the controller 20 stores the received print data onto the image memory 25, and at the same time, controls the adder of the determination circuit 26 to calculate the number of all printing elements SGI (SGI=LY+LM+LC+LK: printing duty) driven in each block at the same time t. Next, at step S22, the electric power Pt necessary for the entire printing at time t (Pt=P0×SGI: P0 is electric power to drive 1 printing element) is calculated. Next, at step S23, the electric power Pt necessary for the entire printing is compared with the threshold value PL, and if the electric power Pt exceeds the threshold value PL, the process proceeds to step S24, at which a flag indicating that the electric power Pt has exceeded the threshold value PL is set, then the process proceeds to step S25. At step S25, it is determined whether the electric power Pt is equal to the maximum value of SGI in the page. If the result of step S25 is positive, then the process goes to step S26, at which SGI value is set to MSGI which is the maximum value of SGI. If the result of step S25 is negative, then the process goes to step S27 without any further operation. On the other hand, if it is determined at step S23 that the electric power necessary for the entire printing does not exceed the threshold value PL, the process proceeds to step S25 without any operation. At step S25, the series of operations end.

Next, the process proceeds to step S3 in FIG. 7, at which it is determined whether or not printing for 1 page can be performed. If printing for 1 page can be performed, the process proceeds to step S4, while if printing for 1 page cannot be performed, the process returns to step S1. As the printheads are arrayed at certain intervals, in some cases, the printheads perform printing over 2 pages. That is, as shown in FIGS. 5 and 6A, the first printhead performs printing for the second page before printing for the first page has been completed. Accordingly, it is necessary to receive data for the second page corresponding to the overlap portion and complete the calculation of the number of printing elements SGI as shown in FIG. 6B at least for the print data for the first page. Note that when printing for 1 page becomes possible depends on the structure of each printing apparatus. Further, as printing cannot be stopped in the middle of printing for 1 page, the amount of overlap portion and the amount of stored data necessary for jam recovery vary in accordance with the interval between the printheads, timing of paper feeding and the like.

Next, at step S4, the flag register 46 is checked and it is determined whether or not the flag indicating that the electric power Pt necessary for the entire printing has exceeded the threshold value PL is set. If the flag is not set (the electric power Pt has not exceeded the threshold value PL), the process proceeds to step S5, at which normal printing is performed, and the process proceeds to step S7. If the flag is set (the electric power Pt has exceeded the threshold value PL), the process proceeds to step S6, at which the printing element driving frequency is lowered so as to reduce the electric power, and printing is performed. That is, in the present embodiment, as a drive signal having a pulse waveform at a constant voltage is applied from the gate array 24 to the respective printheads 31 to 34, in a case where the flag is set in the flag register 46 of the determination circuit 26, the controller 20 changes the frequency of the driving signal applied from the gate array 24 to the respective printheads 31 to 34, thereby controls the electric power supplied to the respective printheads.

FIG. 9 is a flowchart explaining the details of step S6 in FIG. 7. That is, at step S61, the controller 20 changes the driving frequency based on a frequency change table as shown in FIG. 11 (using, e.g., a driving frequency number 1), and at the same time, calculates the electric power Pt again from the driving electric power Px corresponding to the frequency (Pt= Px*SGI). Then at step S62, if the electric power Pt necessary for the entire printing, calculated with the changed frequency, is not less than the threshold value PL, the process returns to step S61, at which the driving frequency is changed again based on the frequency change table as shown in FIG. 11 (using, e.g., a driving frequency number 2), then the process proceeds to step S62.

Further, at step S62, if the electric power Pt necessary for the entire printing calculated with the changed frequency is less than the threshold value PL, the process proceeds to step S63, at which the controller 20 controls the printheads 3, the conveyance belt driving roller 5 and the like for appropriate printing using the changed driving frequency, and the process proceeds to step S65, at which the series of operations end.

Next, at step S7 in FIG. 7, when the printing for 1 page has been completed, it is determined whether or not print data still exists. If there is print data for the next page, the process returns to step S1, while if there is no print data for the next page, the process proceeds to step S8, at which the series of operations end.

As described above, according to the present embodiment, electric power for printing on a print medium by all the printhead is calculated in predetermined time units, and the result of calculation is compared with a predetermined threshold value.

Accordingly, even if preliminary discharge is performed at the same time of print-output of print data, printing beyond the capability of the power source can be prevented, and this arrangement greatly contributes to improvement in the quality of printed image.

Note that the above-described use of preliminary discharge pattern table and the frequency change table is an example but any method may be employed as long as it can change the preliminary discharge pattern and frequency.

[Modification]

In the above embodiment, the number of all printing elements of the printheads is used in the threshold value, however, in a case where the electric power applied to the printing elements is different by each head, calculation is appropriately changed by, e.g., multiplying the threshold value with a coefficient.

Further, in the above embodiment, the threshold value is set once at the beginning, however, in a case where the preliminary discharge pattern is changed, the threshold value may be changed. In this case, it is preferable that plural threshold values previously calculated in correspondence with patterns are stored as a table on the ROM.

[Other Embodiments]

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

The present invention can be applied to a system constituted by a plurality of devices (e.g., a host computer, an interface, a reader and a printer) or to an apparatus comprising a single device (e.g., a copy machine or a facsimile apparatus).

Further, the object of the present invention can also be achieved by providing a storage medium (or recording medium) holding software program code for performing the aforesaid processes to a system or an apparatus, reading the program code with a computer (e.g., CPU, MPU) of the system or apparatus from the storage medium, then executing the program. In this case, the program code read from the storage medium realizes the functions according to the embodiment, and the storage medium holding the program code constitutes the invention. Furthermore, besides aforesaid functions according to the above embodiment are realized by executing the program code which is read by a computer, the present invention includes a case where an OS (operating system) or the like working on the computer performs a part or entire actual processing in accordance with designations of the program code and realizes functions according to the above embodiment.

Furthermore, the present invention also includes a case where, after the program code read from the storage medium is written in a function expansion card which is inserted into the computer or in a memory provided in a function expansion unit which is connected to the computer, CPU or the like contained in the function expansion card or unit performs a part or entire process in accordance with designations of the program code and realizes functions of the above embodiment.

In a case where the present invention is applied to the aforesaid storage medium, the storage medium stores program code corresponding to the flowcharts (FIGS. 7 to 9) described as above.

As described above, according to the present invention, even if preliminary discharge is performed at the same time of print-output of print data, printing can be performed with electric power not greater than electric power that the power source can supply, and this arrangement greatly contributes to improvement in the image quality.

As described above, according to the present invention, provided is a full-line type ink-jet printing apparatus, having plural printheads, which can simultaneously perform print processing of printing using a printhead within a printing area of a print medium on the print medium and preliminary discharge processing on a printhead without the printing area of the print medium, even if electric power necessary for these processing exceeds a maximum value that a power source can supply to the printing apparatus, with electric power not greater than electric power that the power source can supply, in a stable manner.

The present invention is not limited to the above embodiments and various changes and modifications can be made within the spirit and scope of the present invention. Therefore, to appraise the public of the scope of the present invention, the following claims are made.

What is claimed is:

1. An inkjet printing apparatus having plural full-line type inkjet printheads each having an array of printing elements corresponding to a width of a print medium, comprising:

control means for, when print data is received, simultaneously performing print-output of said print data by said printhead within a printing area of said print medium and preliminary discharge from said printhead without said printing area of said print medium;

driving electric-power calculation means for calculating driving electric power to simultaneously perform said print-output of said print data and said preliminary discharge, by a predetermined length in a conveyance direction of said print medium;

determination means for determining whether or not said calculated driving electric power is greater than a threshold value indicating an upper limit of driving electric power to simultaneously perform said print-output of the print data and said preliminary discharge, wherein if said calculated driving electric power is greater than said threshold value, said control means reduces electric power supplied to said printhead to a value less than said threshold value and changes a driving frequency to said printhead; and driving frequency selection means for selecting a predetermined driving frequency from a previously set driving frequency table, wherein said control means controls said driving frequency selection means to select a driving frequency to obtain driving electric power less than said threshold value from said driving frequency table.

2. The inkjet printing apparatus according to claim 1, wherein said threshold value is a value obtained by subtracting electric power necessary for said preliminary discharge from a maximum value of electric power which can be supplied from a power source to said printhead.

3. The inkjet printing apparatus according to claim 1, further comprising preliminary discharge pattern selection means for selecting a predetermined preliminary discharge pattern from a previously set preliminary discharge pattern table.

4. The inkjet printing apparatus according to claim 3, wherein a value of electric power necessary for said preliminary discharge is set for said preliminary discharge pattern and stored in said preliminary discharge pattern table.

5. The inkjet printing apparatus according to claim 1, wherein said printhead discharges ink by utilizing thermal energy and has thermal energy transducers for generating thermal energy to be applied to the ink.

6. A driving control method for an inkjet printing apparatus having plural full-line type inkjet printheads each having an array of printing elements corresponding to a width of a print medium, comprising:

a control step of, when print data is received, simultaneously performing print-output of said print data by said printhead within a printing area of said print medium and preliminary discharge from said printhead without said printing area of said print medium;

a driving electric-power calculation step of calculating driving electric power to simultaneously perform said print-output of said print data and said preliminary discharge, by a predetermined length in a conveyance direction of said print medium;

a determination step of determining whether or not said calculated driving electric power is greater than a threshold value indicating an upper limit of driving electric power to simultaneously perform said print-output of the print data and said preliminary discharge, wherein at said control step, if said calculated driving electric power is greater than said threshold value, electric power supplied to said printhead is reduced to a value less than said threshold value and a driving frequency to said printhead is changed; and a driving frequency selection step of selecting a predetermined driving frequency from a previously set driving frequency table, wherein said control step controls said driving frequency selection step to select a driving frequency to obtain driving electric power less than said threshold value from said driving frequency table.

7. A control program for controlling driving of an inkjet printing apparatus having plural full-line type inkjet printheads each having an array of printing elements corresponding to a width of a print medium, comprising:

a control step of, when print data is received, simultaneously performing print-output of said print data by said printhead within a printing area of said print medium and preliminary discharge from said printhead without said printing area of said print medium;

a driving electric-power calculation step of calculating driving electric power to simultaneously perform said print-output of said print data and said preliminary discharge, by a predetermined length in a conveyance direction of said print medium; and a determination step of determining whether or not said calculated driving electric power is greater than a threshold value indicating an upper limit of driving electric power to simultaneously perform said print-output of the print data and said preliminary discharge, wherein at said control step, if said calculated driving electric power is greater than said threshold value, electric power supplied to said printhead is reduced to a value less than said threshold value and a driving frequency to said printhead is changed; and a driving frequency selection step of selecting a predetermined driving frequency from a previously set driving frequency table, wherein said control step controls said driving frequency selection step to select a driving frequency to obtain driving electric power less than said threshold value from said driving frequency table.

8. A computer-readable storage medium holding a control program for controlling driving of an inkjet printing apparatus having plural full-line type inkjet printheads each having an array of printing elements corresponding to a width of a print medium, wherein said control program comprising:

a control step of, when print data is received, simultaneously performing print-output of said print data by said printhead within a printing area of said print medium and preliminary discharge from said printhead without said printing area of said print medium;

a driving electric-power calculation step of calculating driving electric power to simultaneously perform said print-output of said print data and said preliminary discharge, by a predetermined length in a conveyance direction of said print medium; and a determination step of determining whether or not said calculated driving electric power is greater than a threshold value indicating an upper limit of driving electric power to simultaneously perform said print-output of the print data and said preliminary discharge, wherein at said control step, if said calculated driving electric power is greater than said threshold value, electric power supplied to said printhead is reduced to a value less than said threshold value and a driving frequency to said printhead is changed; and a driving frequency selection step for selecting a predetermined driving frequency from a previously set driving frequency table, wherein said control step controls said driving frequency selection step to select a driving frequency to obtain driving electric power less than said threshold value from said driving frequency table.

* * * * *